United States Patent [19]

Sugahara

[11] Patent Number: 4,475,496

[45] Date of Patent: Oct. 9, 1984

[54] VALVE MECHANISM

[75] Inventor: Eisuke Sugahara, Tokyo, Japan

[73] Assignee: Nippon Piston Ring Co., Ltd., Tokyo, Japan

[21] Appl. No.: 396,546

[22] Filed: Jul. 9, 1982

[30] Foreign Application Priority Data

Jul. 13, 1981 [JP] Japan ..... 56-103489[U]
Sep. 4, 1981 [JP] Japan ..... 56-130951[U]

[51] Int. Cl.[3] ..... F02D 13/06
[52] U.S. Cl. ..... 123/198 F; 123/90.16
[58] Field of Search ..... 123/90.16, 90.17, 90.18, 123/198 F, 90.39, 90.41

[56] References Cited

U.S. PATENT DOCUMENTS

| | | | |
|---|---|---|---|
| 830,099 | 9/1906 | Packard | 123/90.16 |
| 1,409,625 | 3/1922 | Vosbrink | 123/90.16 |
| 2,392,933 | 1/1946 | Mallory | 123/198 F |
| 2,443,999 | 6/1948 | Wright | 123/198 F |
| 2,806,459 | 9/1957 | Sweat | 123/90.16 |
| 2,851,023 | 9/1958 | Durkan | 123/90.16 |
| 2,880,711 | 4/1959 | Roan | 123/90.16 |
| 3,367,312 | 2/1968 | Jonsson | 123/90.16 |

*Primary Examiner*—Ira S. Lazarus
*Attorney, Agent, or Firm*—Sughrue, Mion, Zinn, Macpeak & Seas

[57] ABSTRACT

A rocker arm mechanism is mounted on a rocker shaft via a pair of eccentric bushes, which, when made to rotate in opposite directions, disengage the rocker arm from an associated valve. The device is useful in controlling the number of operating cylinders in a multi-cylinder engine for more efficient fuel consumption.

11 Claims, 9 Drawing Figures

VALVE MECHANISM

BACKGROUND OF THE INVENTION

The present invention relates to a valve mechanism in a multi-cylinder internal combusion engine. In particular, the invention relates to a valve mechanism which is capable of bringing the operation of an intake valve and an exhaust valve to a halt when partially halting cylinder operation in light and medium load conditions during engine operation.

In general, the pumping loss in an internal combustion engine increases in the compression stroke, so that the efficiency of fuel consumption becomes worse in what is called a "light load" condition in which there is an extra output, for example, when idling or when the vehicle descends a slope.

Hence, as a method to cope with this problem, multi-cylinder operation has been partially brought to a halt in accordance with the prior art, thereby enhancing the efficiency of fuel consumption.

As a method of partially halting cylinder operation in the multi-cylinder internal combustion engine, there has been employed a method temporarily stopping the jetting of fuel in an electronically injected engine. However, this method is not satisfactory since it is not available in an engine which is provided with a carburetor, and since the intake valve and the exhaust valve work as usual even in a cylinder for which fuel injection is stopped, so that air is introduced and discharged as the piston reciprocates.

Hence, as a method for partially bringing the cylinder operation to a halt, i.e. for disabling one or more cylinders, it has recently been attempted to stop the operation of the valve by forcibly increasing the gap between the rocker arm and the valve.

Until now, however, there has not been developed any valve mechanism capable of sufficiently favourably operating to stop the operation of the valve in accordance with this or other methods. Accordingly, the development of such a valve mechanism has been urgently required.

A pair of prior art mechanisms seeking to achieve this end are disclosed in Japanese Patant Publication No. 3843/1976 and Japanese Early Disclosure No. 115408/1978.

SUMMARY OF THE INVENTION

In view of the above, the present invention intends to provide an excellent valve mechanism of this type.

That is, in a multi-cylinder internal combustion engine constituted in such a way as to partially bring the cylinder operation to a halt when the engine is driven, the present invention is characterized in that a first bush is inserted on a rocker shaft in such a manner so as to be eccentric with respect to the axis of the rocker shaft, a second bush is inserted on the first bush such as to be eccentric in a direction opposite to the eccentric direction of the first bush with respect to the axis of the first bush, a rocker arm is idly inserted on the second bush, the first bush and the second bush are simultaneously rotated and controlled in directions which are opposite to each other by the same angle with repect to the axis of the rocker shaft, so that the rocker arm is moved in the perpendicularly upper direction, thereby detaching the rocker arm from the valve.

DETAILED DESCRIPTION OF THE PREFERRED EMBODIMENTS

Figure 2:
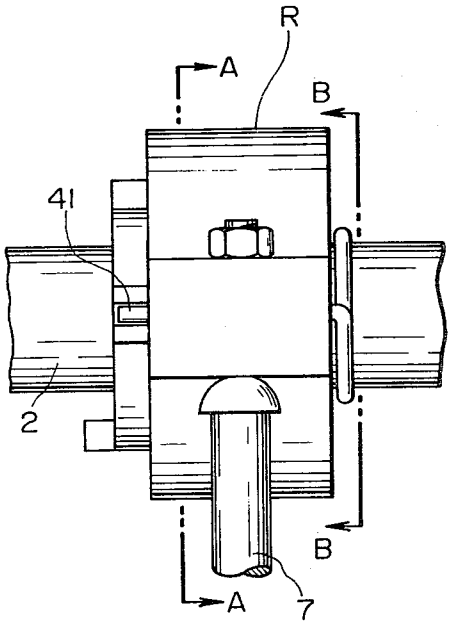
FIG. 2 is a side view of the mechanism of FIG. 1.
Figure 1:
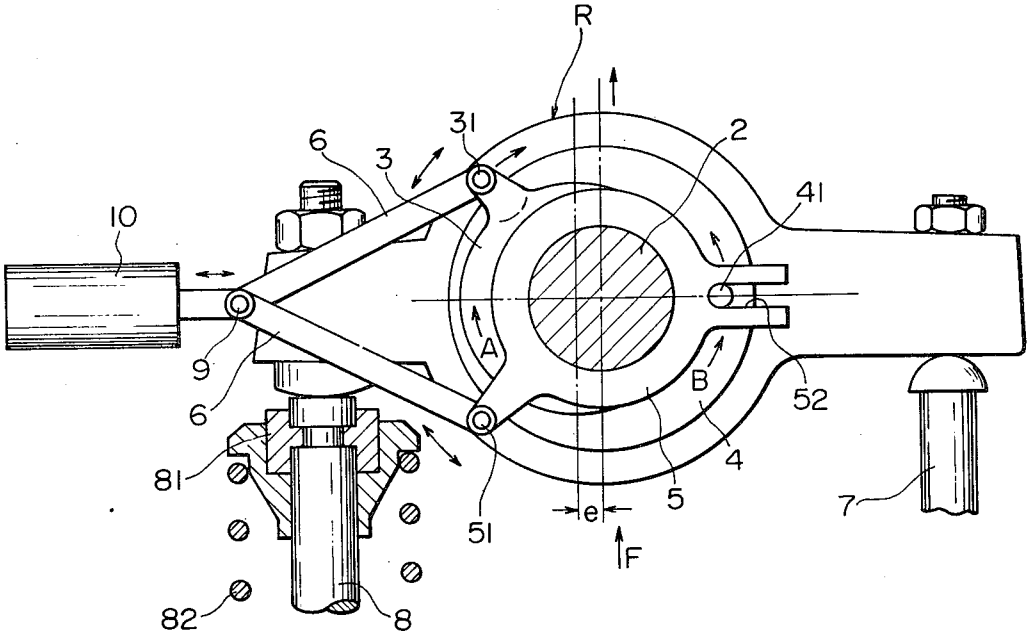
FIG. 1 is a partial front view in cross section, showing a valve mechanism in accordance with a first embodiment of this invention.
Figure 3:
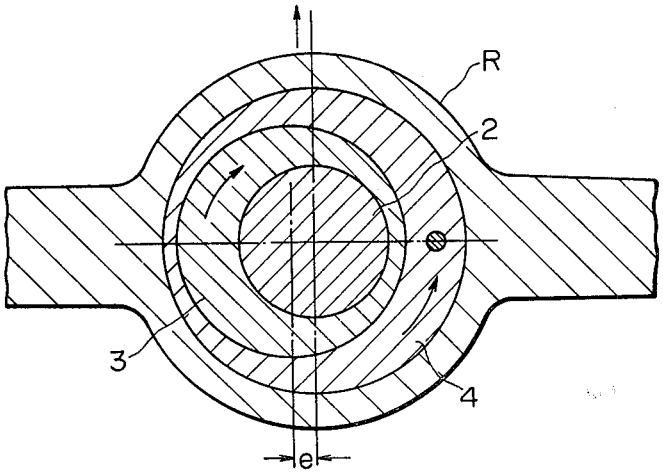
FIG. 3 is a cross sectional view taken along the line A—A of FIG. 2.

A first embodiment is shown in FIG. 1, wherein a rocker arm R undergoes a swinging motion while being in contact with a push rod 7 (a cam in the case of an OHC engine), so as to open and close a valve 8. A first bush 3 is fitted onto a rocker shaft 2 so as to be eccentric by an amount (e) with respect to the axis of the rocker shaft. A second bush 4 is fitted onto the first bush 3 so as to be eccentric by the amount (e) in a direction which is opposite to the eccentric direction of the first bush, with respect to the axis of the first bush. In other words, in this case, the axis of the rocker shaft coincides with that of the second bush. Referring now to FIG. 3, the first bush 3 and the second bush 4 are simultaneously rotated through the same angle with respect to the axis of the rocker shaft 2 and are controlled (the first bush 3 is rotated clockwise and the second bush 4 is rotated counter-clockwise), so that the rocker arm is moved perpendicularly upwards, thereby detaching the rocker arm from the valve 8.

The operations in accordance with the present invention will now be explained in turn. In FIG. 1, a transmitting member 5 is fitted to the rocker shaft 2, and a pin 41 is mounted onto the second bush 4, and is fitted into a groove 52 which is formed at an arbitrary location in the transmitting member 5 (a hole may be formed such that the pin fits into the hole,) so that the transmitting member and the second bush move in conjunction with each other. There are provided connecting pins 31, 51 respectively at locations equidistant from the axis of the rocker shaft on the first bush 3 and the transmitting member 5, and links 6, 6 of equal length are connected to the connecting pins 31, 51. The other ends of the links are connected to each other at a supporting point 9, which is connected to an air cylinder 10. In FIG. 1, the valve 8 which is in contact with the rocker arm R normally effects the intake operation as well as the exhaust operation by the swinging motion of the arm, but when partially bringing cylinder operation to a halt in the light load condition as well as in the middle load condition during operation of the multi-cylinder internal combustion engine, the air cylinder 10 (which may also be an oil cylinder, a solenoid or the like) is operated so that the supporting point 9 is moved horizontally to widen the links 6, 6. Thus, the first bush 3 and the second bush 4 are simultaneously rotated by the same angle in opposite directions with respect to the axis of the rocker shaft 2 via the links 6, 6 and via the transmitting member 5 respectively (the first bush is rotated clockwise and the second bush is rotated counter-clockwise), so as to move the rocker arm R perpendicularly upwards, thereby detaching the rocker arm R from the valve 8. Therefore, even if the rocker arm R swings due to engagement with the push rod 7, the valve 8 does not operate. Thus, cylinder operation is partially brought to a halt during this time.

Figure 5:
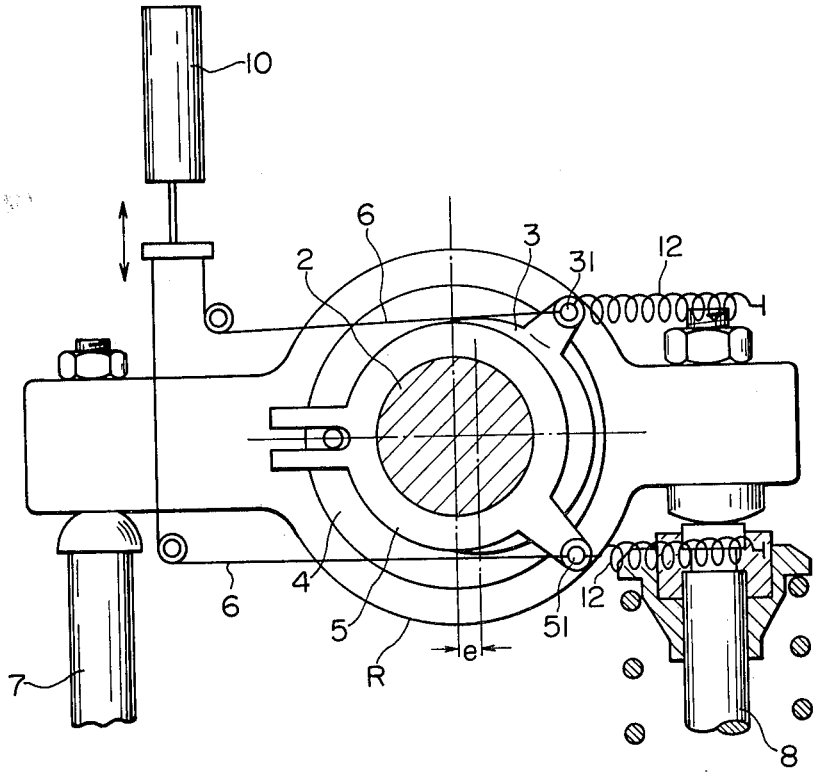
FIG. 5 is a front view, partially in cross section showing a valve mechanism in accordance with a second embodiment of this invention.

If the rocker arm is operated by means of only one eccentric bush, the rocker arm may not move perpendicularly upwards but obliquely upwards, so that it does not contact the push rod but is detached therefrom. In addition, it is required for the eccentric bush to be rotated through a large angle with respect to the axis of the rocker shaft in order to move the rocker arm sufficiently upwardly. However, since eccentric bushes are fitted on the rocker shaft is a overlapping manner in accordance with the present invention, horizontal movement does not occur so that the movement is solely perpendicularly upward. Thus, the rocker arm R is not detached from the push rod 7. Furthermore, since there are two bushes, the eccentric amount is doubled. When compared with the case where only one eccentric bush is provided, the rocker arm is sufficiently moved perpendicularly upwardly with a rotary angle which is one half that when only one eccentric bush is provided. In accordance with another embodiment of this invention, as shown in FIG. 5, wires 6, 6 instead of the links may be respectively connected to the connecting portion 31 of the first bush 3 and to the connecting portion 51 of the transmitting member 5, and to the air cylinder 10. The air cylinder 10 is then operated and the wires 6, 6 are pulled. In so doing, the first bush 3 and the second bush 4 are simultaneously rotated in opposite directions by the same angle with respect to the axis of the rocker shaft, as previously. When it is desired to recover the original state, the elastic force of springs 12, 12 is utilized. The springs 12, 12 are connected and fixed respectively at the connecting portion 31 of the first bush and at the connecting portion 51 of the transmitting member on the side opposite the wires 6, 6.

Figure 4:
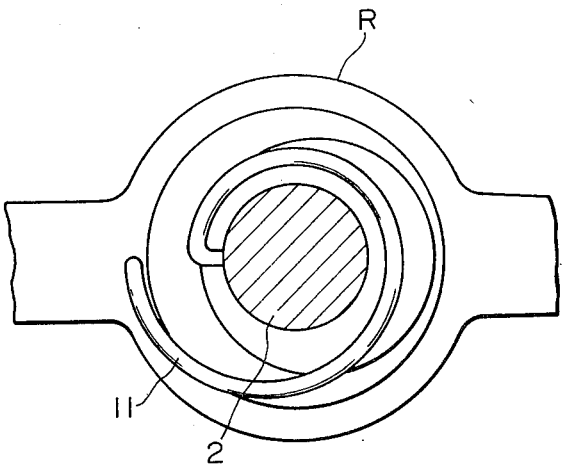
FIG. 4 is a cross sectional view taken along the line B—B of FIG. 2.

In addition, the side of the rocker arm in contact with the push rod and the rocker shaft 2 may be connected by means of a coiled spring 11 (FIG. 4) (which may be a plate spring), so that the arm is urged against the push rod by the elastic force of the coiled spring 11 when the rocker arm R becomes free when cylinder operation is partially brought to a halt; in other words, when the rocker arm R is detached from the valve 8.

In the above embodiment, the first and second bushes are displaced in a horizontal direction from the axis of the rocker shaft 2. Thus, there is an advantage, for example, in that additional space in the vertical direction is not required when designing the engine. However, when the first and second bushes are perpendicularly displaced from the axis of the rocker shaft as in the third embodiment shown in FIGS. 6 and 7, another advantage can be seen. In the first embodiment, when the valve 8 which is in contact with the rocker arm R is performing the intake and exhaust operations under the control of the rocker arm, the first bush 3 is eccentric by an amount (e) on the line X—X which passes through the axis of the rocker shaft 2. On the other hand, the second bush 4 is eccentric by the amount (e) on the line X—X in a direction contrary to the eccentric direction of the first bush. As a result, the first bush 2 and the second bush 3 are subjected to forces in the A-direction and in the B-direction respectively with respect to the functional load in the F-direction when the valve operates, so that the rocker arm R undergoes rocking motion in an unstable state. On some occasions, it becomes difficult to maintain the normal position when the valve operates in the usual manner.

Thus, the third embodiment provides a valve mechanism in accordance with which the rocker arm is maintained in a stable manner and smooth operation is ensured both in normal operation and when partially bringing cylinder operation to a halt in light and middle load conditions.

Figure 6:
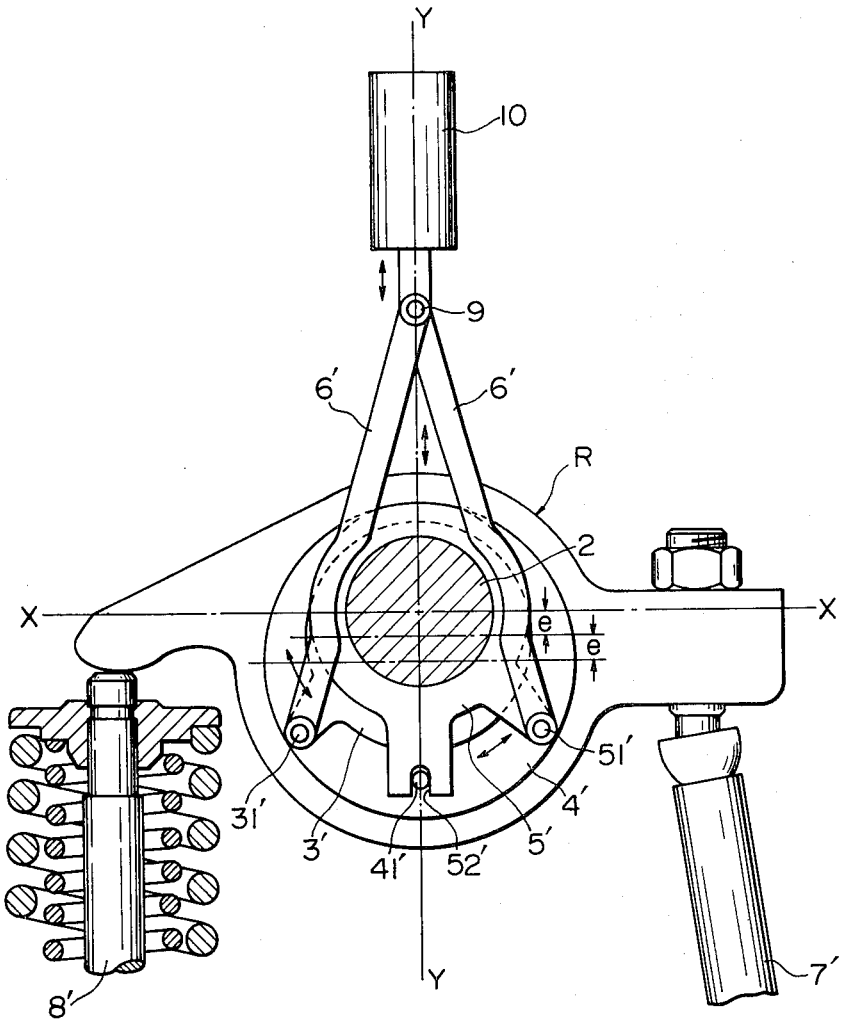
FIG. 6 is a front view, partially in cross section showing a valve mechanism in accordance with a third embodiment of this invention.

As shown in FIG. 6, the rocker arm R is in contact wth a push rod 7' (a cam in the case of an OHC engine) and undergoes rocking motion, thereby opening and closing the valve 8'. The first bush 3' is fitted on the rocker shaft 2 in such a way as to be eccentric in a downward direction by an amount (e) on the line Y—Y which passes through the axis of the rocker shaft 2. The second bush is fitted on the first bush 3' in such a way as to be eccentric by an amount (e) on the line Y—Y in the same direction as the eccentric direction of the first bush, with respect to the axis of the first bush. Now, the principle of this arrangement will be explained with reference to FIG. 7. The first bush 3' and the second bush 4' are simultaneously rotated by the same angle in directions opposite to each other with respect to the axis of the rocker shaft 2 (the first bush is rotated clockwise and the second bush is rotated counterclockwise), and the rocker arm R is moved perpendicularly upwards, thereby detaching the rocker arm from the valve 8'.

Figure 7:
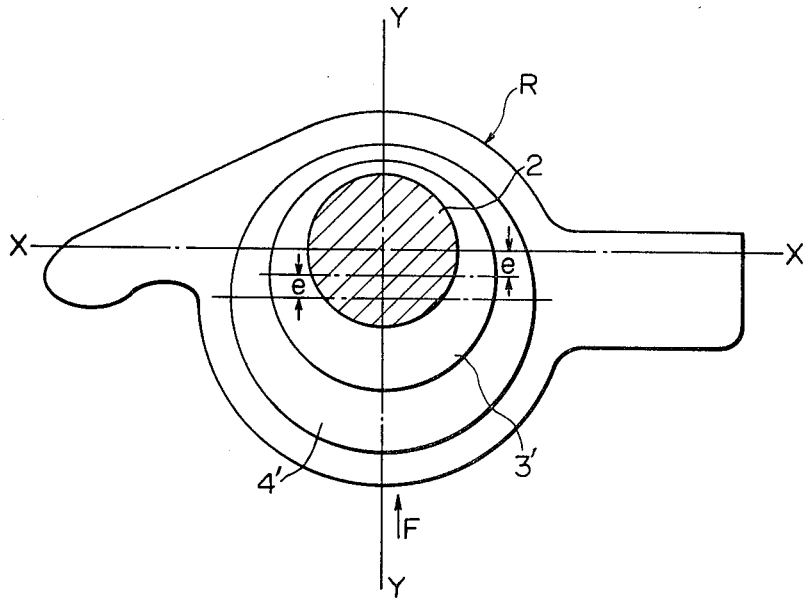
FIG. 7 is a partial cross sectional view schematically showing the working valve of FIG. 6.

Furthermore, since the first bush 3' and the second bush 4' are fitted and combined respectively in such a way as to be eccentric on the same line Y—Y with respect to the axis of the rocker shaft 2 as shown in FIG. 7, it is possible for the rocker arm to stably maintain the normal position with respect to a functional load in the F-direction when the valve in contact with the rocker arm performs the intake and exhaust operations under the control of the valve arm.

Now, the operation in accordance with this embodiment will be in turn explained. In FIG. 6, a transmitting member 5' is fitted to the rocker shaft 2, a pin 41' is mounted on the second bush 4' and is fitted into a hole or groove 52' which is formed at an arbitrary location in the transmitting member 5', so that the transmitting member and the second bush may move in conjunction with each other. There are provided connecting pins 31', 51' respectively at locations which are equidistant from the axis of the rocker shaft on the first bush 3' and the transmitting member 5', and links 6', 6' of equal lengths are connected to the connecting pins 31', 51' respectively, the other ends of the links being connected to each other at the supporting point 9, which is connected to an air cylinder 10'. The valve 8' in contact with the rocker arm R normally performs the intake and exhaust operations due to the rocking motion of the rocker arm shown in FIG. 6, and the air cylinder 10' (which may also be an oil cylinder, a solenoid or the like) is actuated when partially bringing cylinder operation to a halt in the light load and medium load conditions during operation of the multi-cylinder internal combustion engine. Thus, the supporting point 9 is moved perpendicularly upwards. Accordingly, the first bush 3' and the second bush 4' are simultaneously rotated by the same angle in either direction via the links 6', 6' and via the transmitting member 5' with respect to the axis of the rocker shaft 2 (the first bush is rotated clockwise and the second bush is rotated counter-clockwise), so that the rocker arm R is moved perpendicularly upwards and is detached from the valve 8'. Therefore, even if the rocker arm R continues to rock due to the push rod 7', the valve 8' does not work, and cylinder operation is partially brought to a halt.

A single bush could be used to effect the operation above, but would suffer from the same deficiencies noted with respect to the like arrangement of the first embodiment. In the case of this embodiment, horizontal movement does not occur; only the perpendicularly upward movement occurs, and the rocker arm R is not detached from the push rod 7. In addition, by using two bushes, the eccentric amount is doubled.

Figure 8:
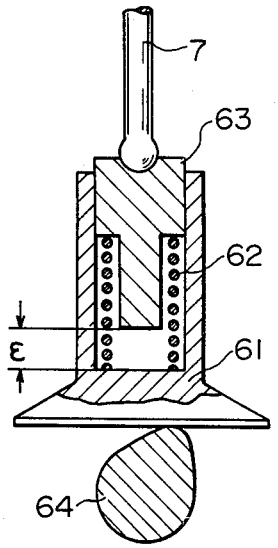
FIGS. 8 and 9 are partial cross sectional views showing additional embodiments of the valve in accordance with the present invention.
Figure 9:
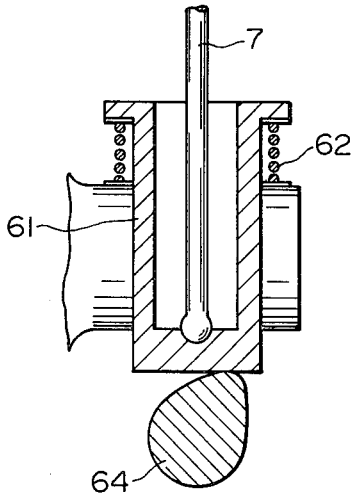

When partially halting cylinder operation in the above mentioned embodiment, that is, when the rocker arm is not in contact with the valve 8, the rocker arm R is in a free state. Thus, an elastic member such as a coiled spring is connected to the rocker shaft and an arbitrary location of the arm on the side to come in contact with the push rod of the rocker arm, so that it pushes against the push rod by the elastic force, or so as to push against the rocker arm from the side of the push rod. That is, there may be provided a gap $\epsilon$ ($\epsilon$ is taken larger than the maximum variable lift amount of the rocker arm) in a tappet 61 with a spring 62 interposed therein, which is in contact with a cam shaft 64 as shown in FIG. 8. A spindle 63 supports the push rod and is slidably fitted in the tappet, and the push rod 7 is pushed against the rocker arm R by the elastic force of the spring 62. This construction is effective since the rocker arm can be stably maintained. The above mentioned effects can also be sufficiently brought about in accordance with a construction such as shown in FIG. 9.

As will be clearly understood from the above, the present invention relates to a valve mechanism in a multi-cylinder internal combustion engine. In particular, the valve in accordance with the present invention provides a stably operating rocker arm which operates normally when the valve is operated in the used manner and which ensures smooth operation when cylinder operation is partially brought to a halt in the light and middle load conditions during the engine operation. Thus, excellent effects can be brought about.

What is claimed is:

1. A device for halting operation of one or more cylinders having valves during engine operation of a multi-cylinder internal combustion engine comprising: a rocker arm, a rocker shaft for supporting said rocker arm, a first bush installed on said rocker shaft to be eccentric with respect to an axis of said rocker shaft, a second bush installed on said first bush to be eccentric with respect to an axis of said first bush, said rocker arm being positioned on said second bush, and means for simultaneously rotating said first and second bushes in opposite directions to one another to move said rocker arm upwardly to thus detach said rocker arm from an associated valve.

2. A device as claimed in claim 1, said first bush being installed on said rocker shaft so as to be eccentric with respect to the axis of said rocker shaft, said second bush being installed on said first bush so as to be eccentric in a direction contrary to the eccentric direction of said first bush, with respect to the axis of said first bush, said rocker arm being positioned on the second bush; and means for simultaneously rotating said first and second bushes through the same angle in opposite directions to one another, to move said rocker arm perpendicularly upwardly to detach said rocker arm from an associated valve.

3. A device as claimed in claim 2, further including a transmitting member fitted to said rocker shaft so as to be in contact with a side surface of said rocker arm, whereby said trasmitting member and the second bush move in conjunction with one another, connecting means provided on said first bush and said transmitting member at locations respectively equidistant from the axis of the rocker shaft, link means of equal lengths having first ends respectively connected to said connecting pins, the other ends of said links being connected to one another at a supporting point, said supporting point being moved so that the links are opened and closed, and the first bush and the second bush being simultaneously rotated through the same angle in opposite directions with respect to the axis of the rocker shaft, respectively, via said links and said transmitting member.

4. A device as claimed in claim 3, including a pin mounted at a location on a side surface of said second bush, said pin being fitted into a groove or hole formed at one end of said transmitting member, such that said transmitting member and second bush move in conjunction with one another.

5. A device as claimed in claim 3, wherein said supporting point to which said other ends of said links are connected is in turn connected to linearly movable means for translating said supporting point.

6. A device as claimed in claim 2, wherein a location of said arm on the side of said rocker arm in contact with movable actuating means and said rocker shaft are connected by means of an elastic member.

7. A device as claimed in claim 6, said elastic member is a spring member.

8. A device as claimed in claim 1, said first bush being mounted on said rocker shaft so as to be eccentric on a vertical line passing through the axis of said rocker shaft with respect to said axis, said second bush being mounted on said first bush so as to be eccentric on said line in the same direction as the eccentric direction of the first bush, with respect to an axis of said first bush, said rocker arm being mounted on said second bush, and means for rotating said first and second bushes simultaneously through the same angle in respective opposite directions with respect to said axis of the rocker shaft, to detach said rocker arm from an associated valve.

9. A device as claimed in claim 8, including a transmitting member disposed so as to be in contact with a side surface of said rocker arm such that said transmitting member and said second bush move in conjunction with one another, connecting pins provided respectively on said first bush and said transmitting member at locations equidistant from the axis of said rocker shaft, link means having equal lengths having first ends connected to said connecting pins, respectively, other ends of said links being connected to each other at a supporting point, said supporting point being movable to open and close the links, said first and second bushes being simultaneously rotated through the same angle in respective opposite directions with respect to the axis of the rocker shaft via said links and said transmitting member.

10. A device as claimed in claim 9, including a pin mounted at a location on a side surface of said second bush, said pin being fitted into a groove or hole formed at one end of said transmitting member, such that said transmitting member and said second bush move in conjunction with one another.

11. A device as claimed in claim 9, including means for linearly translating said supporting point to which said other ends of said links are connected, comprising a pressurized cylinder.

* * * * *